US009334131B2

(12) United States Patent
Suganuma

(10) Patent No.: US 9,334,131 B2
(45) Date of Patent: May 10, 2016

(54) SHEET CONVEYER AND IMAGE READING APPARATUS

(71) Applicant: Brother Kogyo Kabushiki Kaisha, Nagoya-shi, Aichi-ken (JP)

(72) Inventor: Tsuyoshi Suganuma, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/581,331

(22) Filed: Dec. 23, 2014

(65) Prior Publication Data

US 2015/0183598 A1 Jul. 2, 2015

(30) Foreign Application Priority Data

Dec. 27, 2013 (JP) ..... 2013-271983

(51) Int. Cl.

| | |
|---|---|
| ***H04N 1/04*** | (2006.01) |
| ***B65H 3/06*** | (2006.01) |
| ***B65H 1/04*** | (2006.01) |
| ***B65H 3/52*** | (2006.01) |

(52) U.S. Cl.

CPC ..... *B65H 3/0684* (2013.01); *B65H 1/04* (2013.01); *B65H 3/0669* (2013.01); *B65H 3/5223* (2013.01); *B65H 2402/441* (2013.01); *B65H 2402/46* (2013.01); *B65H 2402/515* (2013.01); *B65H 2402/543* (2013.01); *B65H 2403/531* (2013.01); *B65H 2405/324* (2013.01); *B65H 2405/3321* (2013.01); *B65H 2801/39* (2013.01)

(58) Field of Classification Search

CPC .. B65H 3/0684; B65H 3/0669; B65H 3/5223; B65H 2402/441; B65H 2402/46; B65H 2402/515; B65H 2402/543

USPC ..... 358/498, 497, 496, 474

See application file for complete search history.

(56) References Cited

U.S. PATENT DOCUMENTS

2013/0193632 A1* 8/2013 Hida ..... B65H 3/0684 271/10.11

FOREIGN PATENT DOCUMENTS

| | | | |
|---|---|---|---|
| JP | H0710300 | A | 1/1995 |
| JP | H0753540 | B2 | 6/1995 |
| JP | 2001-294335 | A | 10/2001 |
| JP | 2006-124044 | A | 5/2006 |
| JP | 2007-254146 | A | 10/2007 |

* cited by examiner

*Primary Examiner* — Houshang Safaipour
(74) *Attorney, Agent, or Firm* — Banner & Witcoff, Ltd.

(57) ABSTRACT

A sheet conveyer, comprising: a sheet support surface; a first roller to convey sheets; a second roller to separate one by one the sheets; a holder to be swingably supported about a swing center axis, wherein the first roller is attached to the holder to be rotatable; and a pressing unit to press the first roller toward the sheet support surface, wherein the pressing unit is disposed between a first portion of the holder and a second portion opposite to the sheet support surface with respect to the holder, the pressing unit is configured to press the first portion to move away from the second portion, and the pressing unit and the first roller are disposed not to overlap with each other in regard to an axis direction of the first roller.

15 Claims, 8 Drawing Sheets

SHEET CONVEYER AND IMAGE READING APPARATUS

CROSS-REFERENCE TO RELATED APPLICATION

This application claims priority under 35 U.S.C. §119 from Japanese Patent Application No. 2013-271983, filed on Dec. 27, 2013. The entire subject matter of the application is incorporated herein by reference.

BACKGROUND

1. Technical Field

The following disclosure relates to a sheet conveyer and an image reading apparatus.

2. Related Art

Conventionally, a sheet conveyer comprising a first roller which conveys sheets placed on a sheet support unit to a downstream side in a conveying direction and a second roller which separates the sheets conveyed by the first roller one by one and sends the sheet to the downstream side in the conveying direction has been proposed.

For example, in a sheet conveyer of this type, a pickup roller corresponding to the above described first roller is rotatably supported by a pickup arm. The pickup arm is supported to be swingable about a swing axis equal to a drive axis, i.e., a rotation center axis, of a separation roller corresponding to the second roller. The pickup roller swings together with the pickup arm, and as a result an interval between the pickup roller and a paper supply tray is changed.

SUMMARY

In the above described conventional sheet conveyer, the number of rotations of a motor for swinging the pickup roller is controlled depending on the type of sheet being used. As a result, the pressing force of the pickup roller with respect to the sheet is changed so that the sheet feeding force of the pickup roller is adjusted to appropriately feeding the sheet of the type being used.

However, in the case where the pressing force of the pickup roller with respect to the sheet is adjusted by controlling the number of rotations of the motor, complicated control is needed to appropriately convey the sheets to the downstream side in the conveying direction regardless of the number of placed sheets. Furthermore, it is difficult to achieve such an appropriate pressing force by only the weight of the pickup roller.

Aspects of the disclosure relate to a sheet conveyer and an image reading apparatus capable of appropriately feeding sheets regardless of the number of placed sheets without the need for complicated control.

In one aspect of the disclosure, there is provided a sheet conveyer comprising: a sheet support surface configured to support sheets; a first roller configured to convey the sheets supported by the sheet support surface to a downstream side in a conveying direction; a second roller configured to separate one by one the sheets conveyed by the first roller to convey a sheet to the downstream side in the conveying direction; a holder configured to be swingably supported about a swing center axis coinciding with a rotation center of the second roller, wherein the first roller is attached to the holder to be rotatable about an axis parallel with the swing center axis; and a pressing unit configured to press the first roller toward the sheet support surface by applying a pressing force to the holder. In this configuration, the pressing unit is disposed between a first portion of the holder and a second portion opposite to the sheet support surface with respect to the holder, and the pressing unit is configured to press the first portion to move away from the second portion. The pressing unit and the first roller are disposed not to overlap with each other in regard to an axis direction of the first roller.

In another aspect of the disclosure, there is provided an image reading apparatus comprising: a reading unit configured to read an image on a sheet conveyed along a predetermined conveying direction; a sheet support surface configured to support sheets; a first roller configured to convey the sheets supported by the sheet support surface to a downstream side in a conveying direction; a second roller configured to separate one by one the sheets conveyed by the first roller to convey a sheet to the downstream side in the conveying direction; a holder configured to be swingably supported about a swing center axis coinciding with a rotation center of the second roller, wherein the first roller is attached to the holder to be rotatable about an axis parallel with the swing center axis; and a pressing unit configured to press the first roller toward the sheet support surface by applying a pressing force to the holder. In this configuration, the pressing unit is configured disposed between a first portion of the holder and a second portion opposite to the sheet support surface with respect to the holder, the pressing unit is configured to press the first portion to move away from the second portion. The pressing unit and the first roller are disposed not to overlap with each other in regard to an axis direction of the first roller.

BRIEF DESCRIPTION OF THE ACCOMPANYING DRAWINGS

For a more complete understanding of the present disclosure, needs satisfied thereby, and the objects, features, and advantages thereof, reference now is made to the following illustrative descriptions taken in connection with the accompanying drawings.

FIGS. 2A and 2B illustrate an internal structure of an image reading apparatus according to the embodiment, in which FIG. 2A is a vertical cross section illustrating a state where a first cover is closed and FIG. 2B is a vertical cross section illustrating a state where the first cover is opened.

FIGS. 6A and 6B are partial cross sections cut along a line VI-VI indicated in FIG. 5B, in which FIG. 6A is a partial cross section illustrating a state where a feed roller is disposed at a lowermost position and FIG. 6B is a partial cross section illustrating a state where the feed roller is disposed at an uppermost position.

Figure 5A:
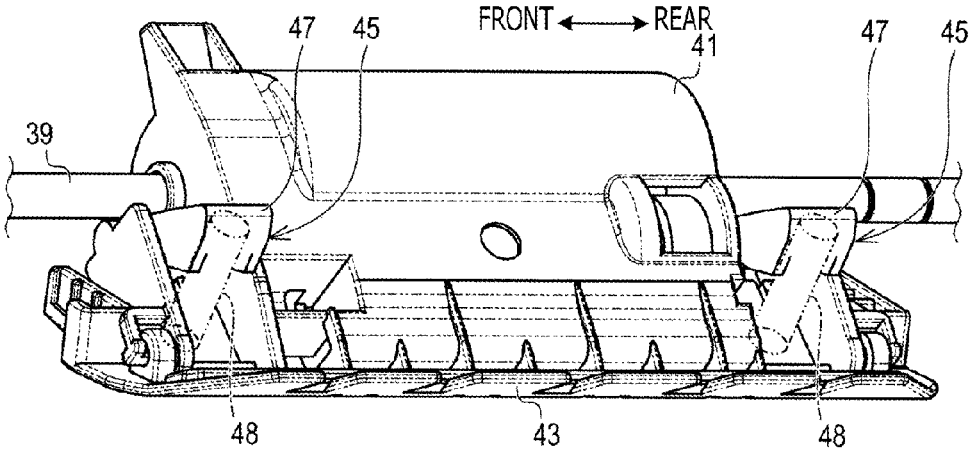
FIG. 5A is a perspective view illustrating a holder, a guide part and a pressing part.
Figure 5B:
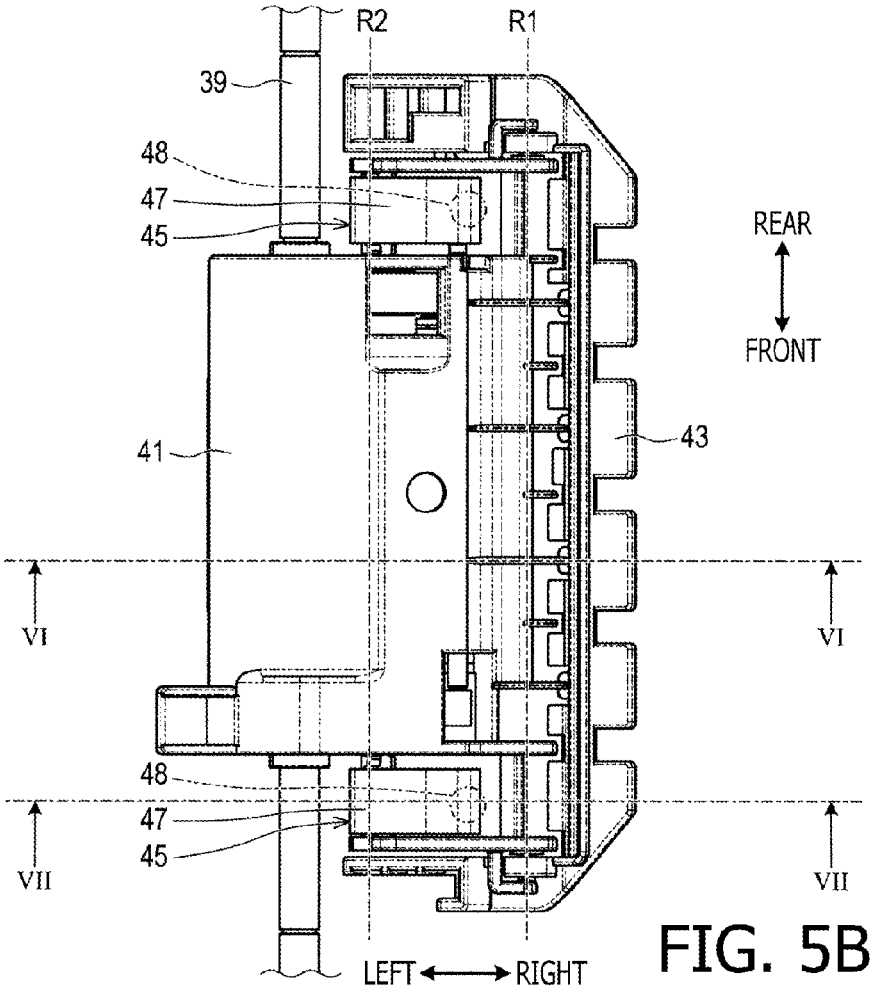
FIG. 5B is a plan view illustrating the holder, the guide part and the pressing part.
Figure 7A:
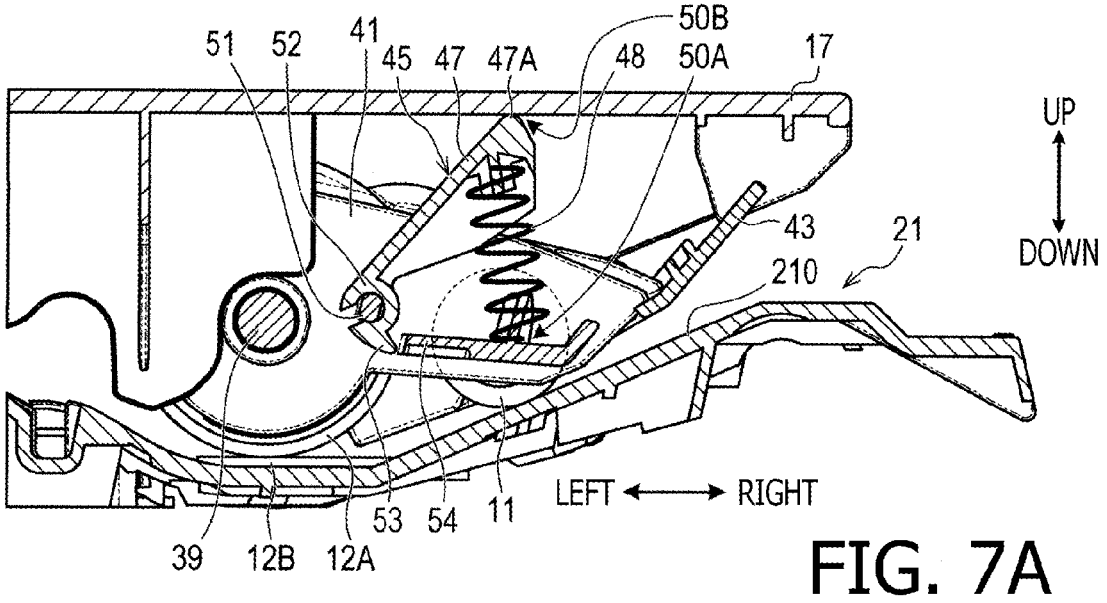
Figure 7B:
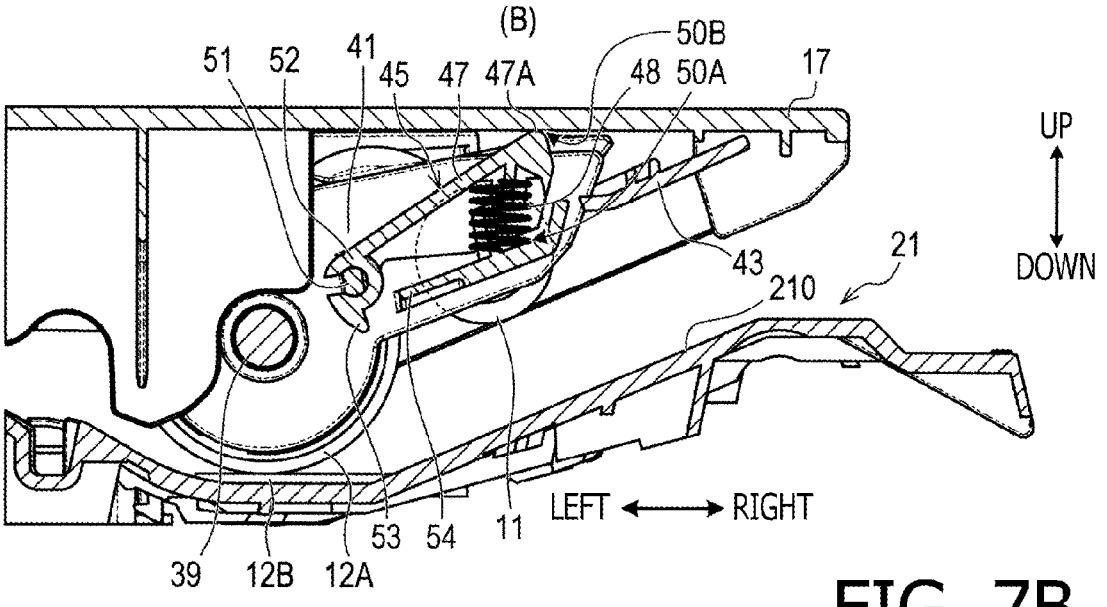
Figure 7C:
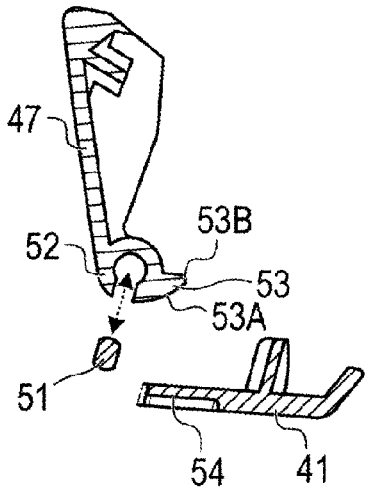
Figure 7D:
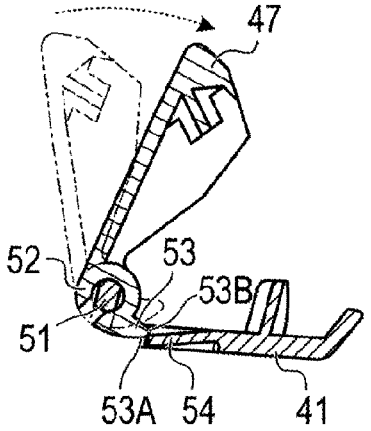
Figure 7E:
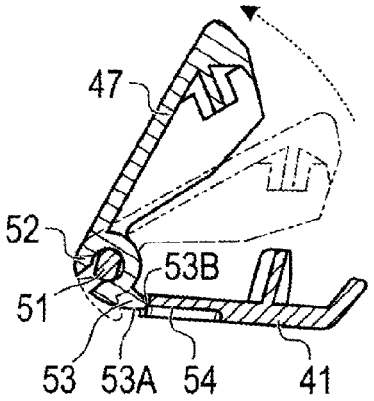

FIG. 7A is a partial cross section cut along a line VII-VII indicated in FIG. 5B illustrating a state where the feed roller is disposed at the lowermost position, FIG. 7B is a partial cross section cut along the line VII-VII indicated in FIG. 5B illustrating a state where the feed roller is disposed at the uppermost position, and FIGS. 7C to 7E are explanatory illustrations for explaining a movable range of a contacting member.

DETAILED DESCRIPTION

Hereafter, a sheet conveyer and an image reading apparatus according to an embodiment will be described with reference to the accompanying drawings.

Configuration of Multifunction Peripheral

Figure 1:
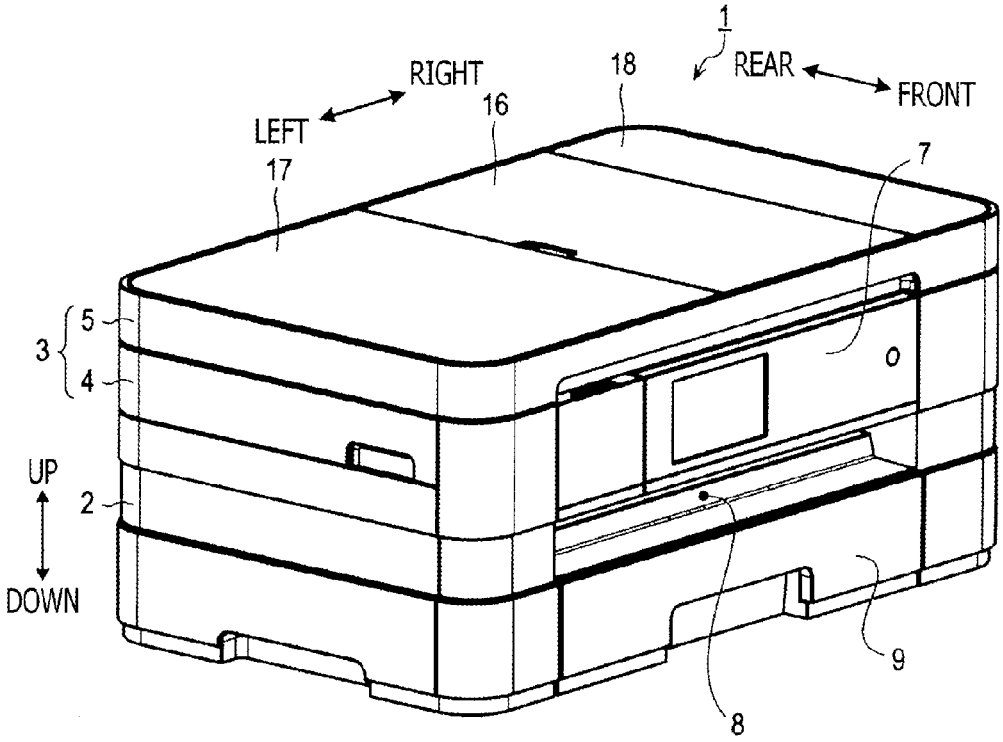
FIG. 1 is a perspective view of a multifunction peripheral according to an embodiment.

A multifunction peripheral 1 shown in FIG. 1 is provided with the sheet conveyer and the imaging reading apparatus according to the embodiment. In the following explanation, in order to explain a relative positional relationship between components constituting the multifunction peripheral 1, up, down, left and right directions written in the drawings are used.

The multifunction peripheral 1 includes a main body unit 2 and a reading unit 3 mounted on the upper side of the main body unit 2. The reading unit 3 is attached to the main body unit 2 to be openable and closable with respect to the main body unit 2. In a state where the reading unit 3 is closed, an opening formed on the upper surface of the main body unit 2 is covered with the reading unit 3.

The reading unit 3 includes a flat bed (hereafter, abbreviated as "FB") unit 4, and an ADF unit 5 provided on the upper side of the FB unit 4. The ADF unit 5 is attached to the FB unit 4 to be openable and closable with respect to the FB unit 4. In the state where the ADF unit 5 is closed, the ADF unit 5 serves as a cover covering the upper surface of the FB unit 4.

In the main body unit 2, various units including a control unit, an image formation unit, a LAN communication unit and a PSTN communication unit are provided. At the upper front part of the main body unit 2, an operation panel 7 to be operated by a user is provided. Below the operation panel 7, an output port 8 through which a recording medium on which an image has been formed in the image formation unit is picked up is formed. Below the output port 8, a media supply cassette 9 in which recording media to be supplied to the image formation unit is stored is attached.

Figure 2A:
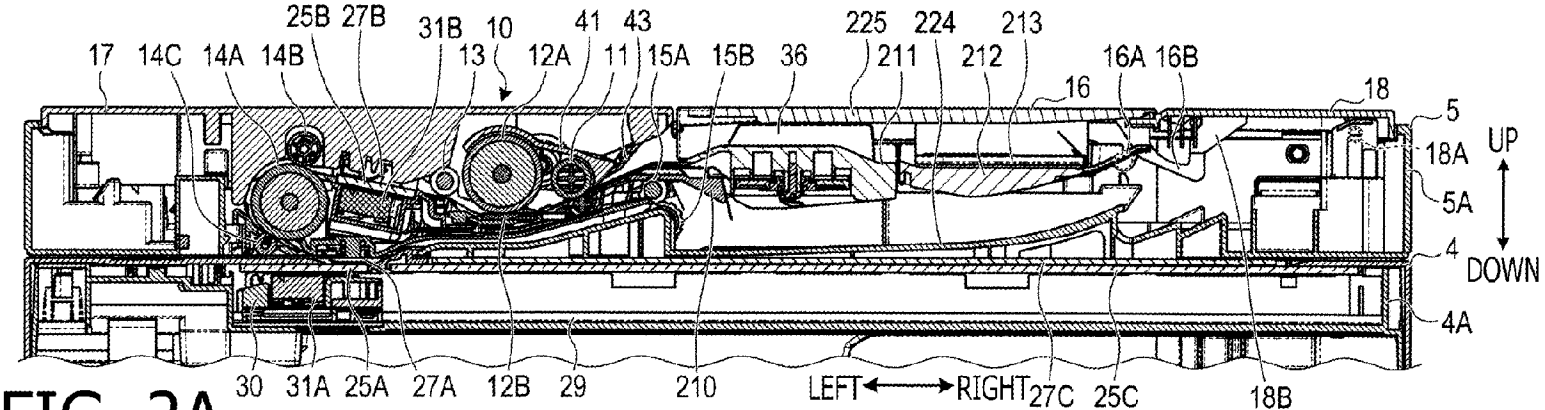
Figure 2B:
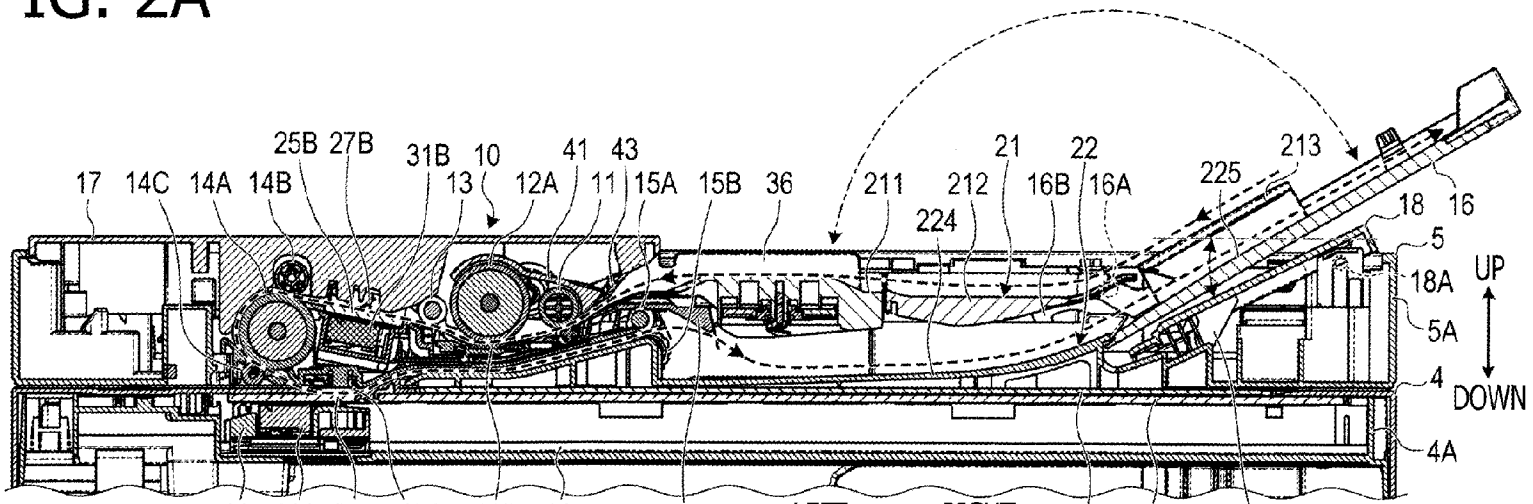

As shown in FIGS. 2A and 2B, the ADF unit 5 is provided with a conveying unit 10 which conveys a document along a predetermined conveying path (indicated by a thick dashed line in FIG. 2B). The conveying unit 10 includes a feed roller 11, a separation roller 12A, a separation piece 12B, an intermediary roller 13, a conveying roller 14A, an upper pinch roller 14B, a lower pinch roller 14C, a discharge roller 15A and a discharge pinch roller 15B.

As shown in FIGS. 2A and 2B, on the upper surface of the ADF unit 5, a first cover 16, a second over 17 and a third cover 18 are provided. The first cover 16, the second cover 17 and the third cover 18 constitute an outer covering of the ADF unit 5 together with a ADF base 5A forming a bottom part and a side wall part of the ADF unit 5.

The first cover 16 is rotatable between a stored position shown in FIG. 2A and a use position shown in FIG. 2B with respect to a rotation shaft 16A positioned close to the right edge of the first cover 16 disposed at the stored position. The third cover 18 is rotatable between a horizontal position shown in FIG. 2A and an inclined position shown in FIG. 2B, with respect to a rotation shaft 18A positioned close to the right edge of the third cover 18.

In the state where the first cover 16 and the third cover 18 are at the positions shown in FIG. 2A, a boss (not shown) provided at a tip of an arm 16B formed to extend from the first cover 16 enters an arm receiver 18B formed on a lower surface of the third cover 18, and the boss supports the third cover 18 from the lower side. That is, since the arm 16B extending from the first cover 16 supports the third cover 18 from the lower surface, the first cover 16 and the third cover 18 form a horizontal surface. The term "horizontal" as used herein means a case where the first cover 16 and the third cover 18 form a completely horizontal surface as well as a case where the first cover 16 and the third cover 18 form a surface having a small degree of unevenness or inclined parts. When the first cover 16 is rotated from the stored position to the use position in this state, the boss of the arm 16B moves downward and lets the left edge part of the third cover 18 moves downward. As a result, the third cover 18 rotates from the horizontal position shown in FIG. 2A to the inclined position shown in FIG. 2B in conjunction with rotation of the first cover 16.

When the first cover 16 rotates from the stored position to the use position, the third cover 18 reaches the inclined position before the first cover 16 reaches the use position. However, the boss of the arm 16B thereafter moves away from the arm receiver 18B and reaches the use position without letting the third cover 18 move. Furthermore, when the first cover 16 rotates from the use position to the stored position, the first cover 16 rotates initially without letting the third cover 18 move, but the boss of the arm 16B enters the arm receiver 18B before the first cover 16 reaches the stored position. Therefore, the boss of the arm 16B thereafter lifts up the left edge part of the third cover 18 until the first cover 16 reaches the stored position. As a result, the third cover 18 rotates in conjunction with rotation of the first cover 16, and the third cover 18 reaches the horizontal position at substantially the same time that the first cover 16 reaches the stored position.

In the state where the first cover 16 has moved to the use position, in the ADF unit 5, a first support unit 21 and a second support unit 22 are formed. The first support unit 21 supports, from the below, the document before being supplied to the conveying unit 10, and the second support unit 22 supports, from the below, the document after being discharged from the conveying unit 10. At least a part of the first support unit 21 and at least a part of the second support unit 22 are positioned to overlap with each other in the up and down direction to have an interval therebetween. In this case, the first support unit 21 is disposed on the upper side of the second support unit 22, and the second support unit 22 is disposed on a lower side of the first support unit 21.

As shown in FIGS. 2A and 2B, the first support unit 21 includes a chute member 210 which guides the document in a downwardly slanting direction in the conveying unit 10, a first tray 211 which supports the document at a position nearest to the chute member 210 disposed on the conveying unit 10 side, a second tray 212 which supports the document at a position further from the conveying unit 10 side than the first tray 211, and a third tray 213 which supports the document at a position further from the conveying unit 10 side than the second tray 212. The chute member 210, the first tray 211, the second tray 212 and the third tray 213 constitute a sheet support surface which supports documents. The second support unit 22 includes a fourth tray 224 which supports the document at a position nearest to the conveying unit 10 side and a fifth tray 225 which supports the document at a position further from the conveying unit 10 side than the fourth tray 224. The fifth tray 225 is formed of one side of the first cover 16, and the third tray 213 is attached to the one side of the first cover 16 to have an interval between the third tray 213 and the fifth tray 225. Therefore, in the state where the first cover 16 is moved to the use position, the third tray 213 and the fifth tray 215 are disposed at positions for constituting the first support unit 21 and the second support unit 22, respectively. In the state where the first cover 16 is moved to the stored position, the first cover 16 covers the upper side of the first tray 211 and the second tray 212, and the third tray 213 and the fifth tray 225 moved together with the first cover 16 are stored in the inside of the ADF unit 5 in the state where the third tray 213 and the fifth tray 225 are oriented downward.

The document placed on the first support unit 21 is conveyed along the conveying path indicated by the thick dashed line shown in FIG. 2B, and is discharged to the second support unit 22. At this time, the documents conveyed to the downstream side in the conveying direction from the first support unit 21 by the feed roller 11 are separated by the separation roller 12A and the separation pieces 12B one by one. Then, the document is conveyed further by the intermediary roller 13 and the conveying roller 14A to the downstream side in the conveying direction, and is discharged to the upper surface of the second support unit 22 by the discharge roller 15A.

A first transparent unit 25A and a first document presser 27A are provided between the conveying roller 14A and the discharge roller 15A on the conveying path. Further, A second transparent unit 25B and a second document presser 27B are provided between the intermediary roller 13 and the conveying roller 14A on the conveying path.

The first transparent unit 25A is disposed on the FB unit 4 side, and the second transparent unit 25B, the first document presser 27A and the second document presser 27B are disposed on the ADF unit 5 side. In this embodiment, each of the first transparent unit 25A and the second transparent unit 25B is formed of a glass plate, and is configured to extend, in a range exceeding the width of the document, in the width direction which is orthogonal to the conveying direction of the document.

Each of the first document presser 27A and the second document presser 27B is made of metal or rigid resin, and is formed to extend in a range exceeding the width of the document as in the case of the first transparent unit 25A and the second transparent unit 25B.

The first document presser 27A is pressed toward the first transparent unit 25A side by a spring (not shown), and prevents the document passing the first transparent unit 25A while contacting the upper surface of the first transparent unit 25A from rising from the first transparent unit 25A side. The second document presser 27B is pressed toward the second transparent unit 25B side by a spring (not shown), and prevents the document passing the second transparent unit 25B while contacting the upper surface of the second transparent unit 25B from rising from the second transparent unit 25B side.

A third transparent unit 25C is provided in the FB unit 4, and a third document presser 27C is provided in the ADF unit 5. In this embodiment, the third transparent unit 25C is made of a glass plate as in the case of the first transparent unit 25A and the second transparent unit 25B. However, the third transparent unit 25C has a sufficiently wide area to the extent that the entire document targeted for image reading is included.

The third document presser 27C is formed of a laminated body in which a foamed resin layer and a rigid resin layer are laminated. When the ADF unit 5 is closed, the third document presser 27C closely contacts the third transparent unit 25C with a small degree of elastic deformation, and prevents the document placed on the third transparent unit 25C from rising from the third transparent unit 25C side.

The FB unit 4 includes a guide rail 29, a carriage 30 and a first image sensor 31A. The ADF unit 5 includes a second image sensor 31B. The guide rail 29 is integrally provided with the inner surface of the bottom part of a housing 4A of the FB unit 4. More specifically, the guide rail 29 is configured to extend in the left and right direction, in a range extending from a position under the first transparent unit 25A to a position under the third transparent unit 25C in the state where the guide rail 29 is in parallel with the lower surfaces of the first transparent unit 25A and the third transparent unit 25C.

The carriage 30 is attached to the upper side of the guide rail 29. As a result, the carriage 30 is supported in the state where the carriage 30 is able to reciprocate in the left and right direction along the guide rail 29. The carriage 30 is coupled to a timing belt (not shown), and reciprocates in accordance with circular driving of the timing belt.

In this embodiment, each of the first image sensor 31A and the second image sensor 31B uses a contact type image sensor (CIS; Contact Image Sensor). The first image sensor 31A is mounted on the carriage 30, and moves to reciprocate in the left and right direction together with the carriage 30.

A spring (not shown) is provided to intervene between the first image sensor 31A and the carriage 30, and the first image sensor 31A is pressed toward the upper side. Further, a spacer (not shown) is attached near the both ends in the front and rear direction of the first image sensor 31A. The spacer is pressed upward together with the first image sensor 31A. The space is able to contact the lower surface of the third transparent unit 25C or the first transparent unit 25A.

With this configuration, when the first image sensor 31A reciprocates with the carriage 30, the spacer maintains the state where the spacer contacts the lower surface of the third transparent unit 25C or the first transparent unit 25A. The first image sensor 31A moves while maintaining a constant distance with respect to the third transparent unit 25C or the first transparent unit 25A.

The second image sensor 31B is disposed at a predetermined position, and does not move from the predetermined position. However, the second image sensor 31B is also pressed toward the second transparent unit 25B side by a spring (not shown). As a result, the second image sensor 31B is disposed to maintain a constant distance with respect to the second transparent unit 25B.

A plurality of reading elements provided in each of the first image senor 31A and the second image sensor 31B are aligned in the front and rear direction defined in this embodiment. When an image of a document placed on the third transparent unit 25C is read, the first image sensor 31A moves along with the carriage 30 to read the image of the document.

When an image of a document being conveyed by the conveying unit 10 is read, the first image sensor 31A stops at a position under the first document presser 27A and the first transparent unit 25A, and reads the image of the document passing therethrough while contacting the upper surface of the first transparent unit 25A. The second image sensor 31B is disposed under the second document presser 27B and the second transparent unit 25B, and reads the image of the document passing therethrough while contacting the upper surface of the second transparent unit 25B.

Figure 3:
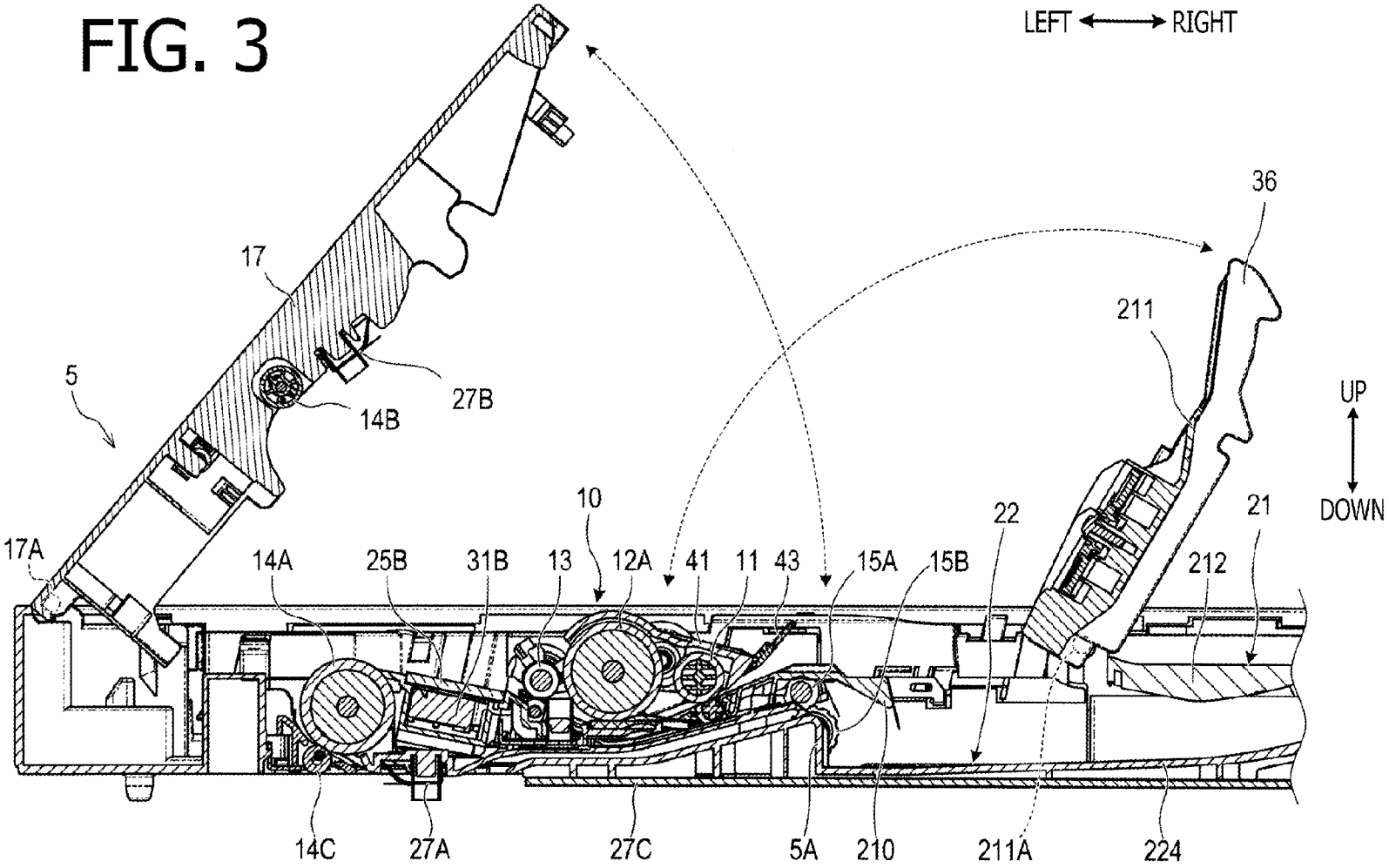
FIG. 3 is a partial cross section illustrating a state where a second cover and a first tray are opened.

As shown in FIG. 3, the first tray 211 is provided to be rotatable about a rotation shaft 211A, and is movable between a closed position shown in FIG. 2B and an opened position shown in FIG. 3. The first tray 211 supports the document at the closed position. On the other hand, when the first tray 211 has moved to the opened position, a part of the fourth tray 224 disposed under the first tray 211 is exposed. As shown in FIG. 3, the second cover 17 is rotatable about a rotation shaft 17A, and moves between a closed position shown in FIG. 2B and an opened position shown in FIG. 3.

Figure 4:
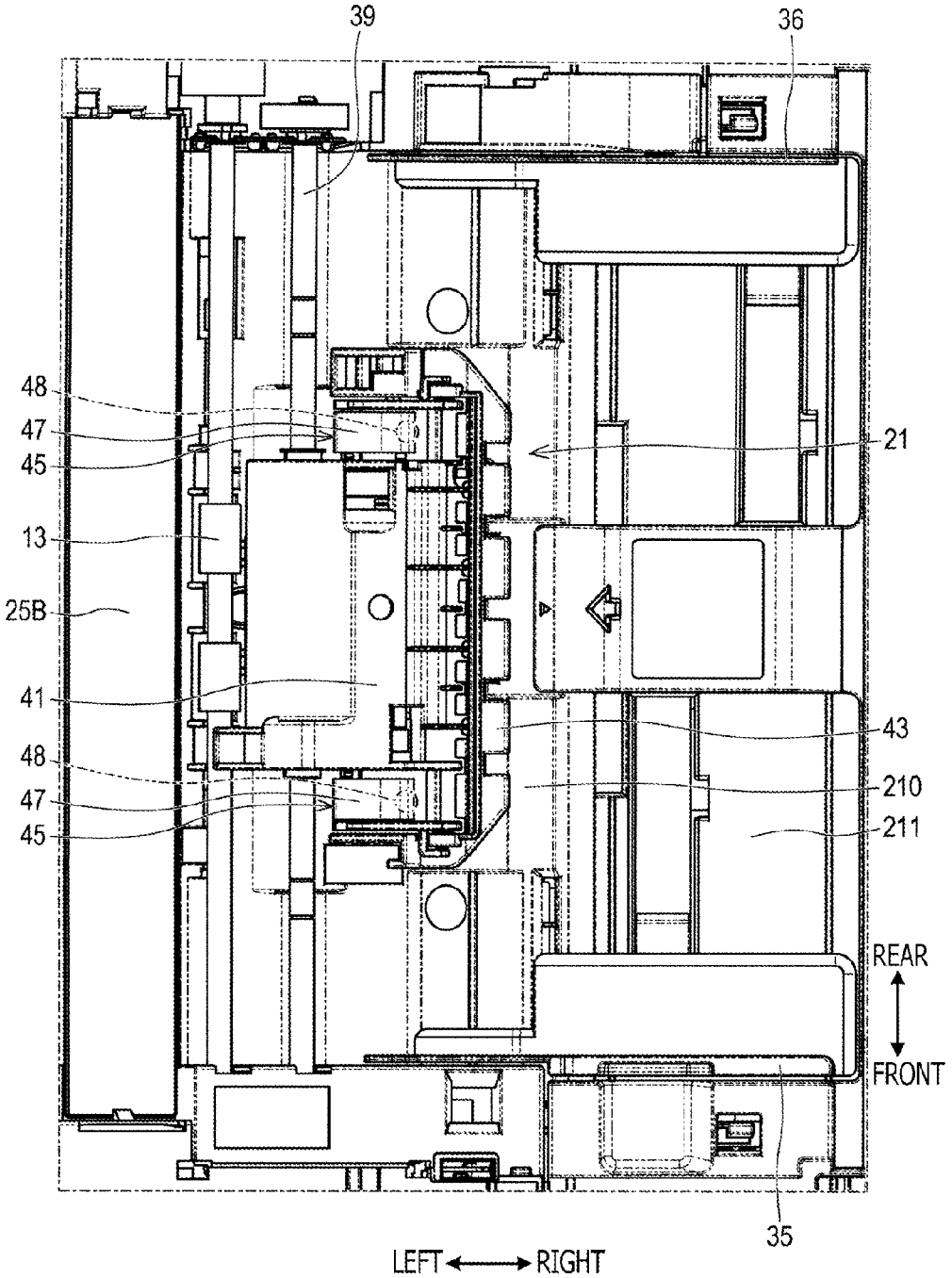
FIG. 4 is a plan view illustrating a configuration of a holder and a peripheral part thereof.

As shown in FIG. 4, side guides 35 and 36 are attached to the first tray 211. The side guides 35 and 36 are disposed to have an interval therebetween in a width direction (the front and rear direction in FIG. 4) which is perpendicular the conveying direction of the document. Each of the side guides 35 and 36 is slidable in the front and rear direction relative to the first tray 211. The side guides 35 and 36 are configured such that when one of the side guides 35 and 36 slides, the other of the side guides 35 and 36 also slides in conjunction with movement of the one of the side guides 35 and 36. When a document is placed on the first support unit 21, the side guides 35 and 36 contact edges in the width direction of the document, and restricts the conveying direction of the document to a predetermined direction.

Details about Holder and Pressing Unit

Figure 6A:
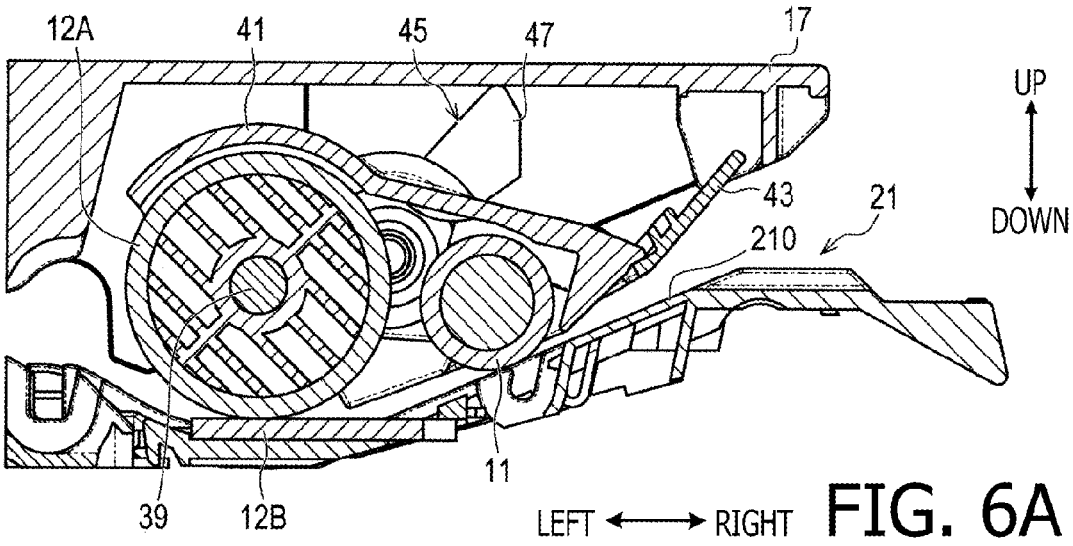
Figure 6B:
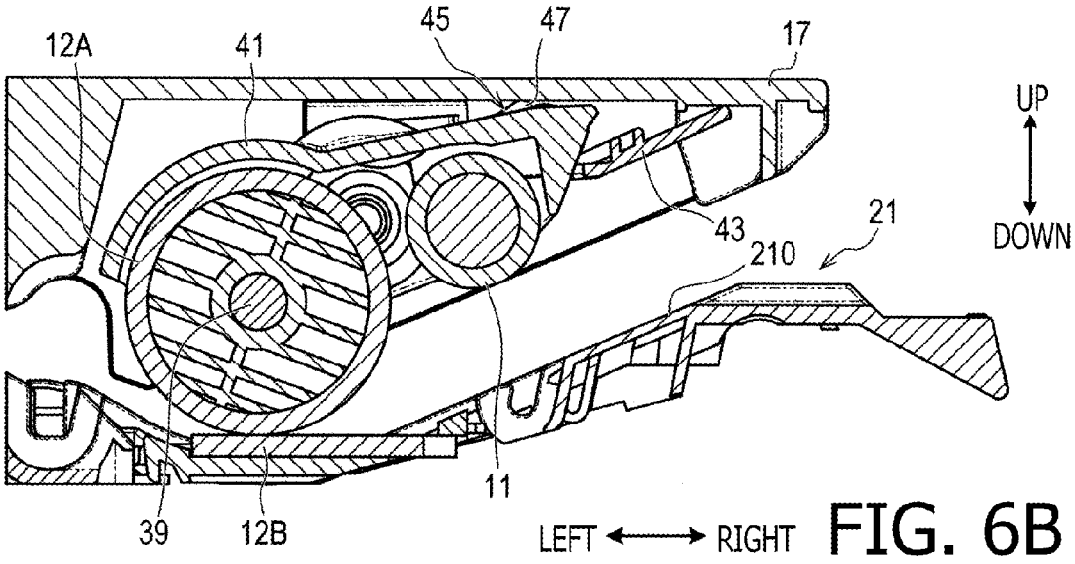

As shown in FIGS. 4, 5A and 5B, a holder 41 is attached to a rotation shaft 39 which rotatably supports the separation roller 12A. The holder 41 is supported to be swingable about an axis line which coincides with the rotation center axis of the separation roller 12A. In the state where the second cover 17 is at the closed position, the holder 41 is swingable between the lowest position shown in FIGS. 6A and 7A and the highest position shown in FIGS. 6B and 7B. The feed roller 11 is rotatably attached to the holder 16, and the feed roller 11 rotates about an axis line which is parallel with the swing center axis of the holder 41. The feed roller 11 swings together with the holder 41, and thereby the interval between the feed roller 11 and the first support unit 21 (specifically, the chute member 210) is changed.

A guide part 43 and a pair of pressing parts 45 and 45 are attached to the holder 41. The guide part 43 is disposed at a position surrounding the holder 41 from the three sides including a part of the front side, the right side and a part of the rear side of the holder 41. The guide part 43 is attached to the holder 41 to be swingable, and swings about an axis line R1 shown in FIG. 5B.

The pressing parts 45 and 45 are attached, on the upper surface side of the holder 41, to both ends of the holder 41 in an axis direction (the front and rear direction in this embodiment) being the swing axis line. Each of the pressing parts 45 and 45 includes a contacting member 47 and a spring member 48. The contacting members 47 and 47 are swingably attached to the holder 41, and swing about an axis line R2 shown in FIG. 5B. As shown in FIGS. 7A and 7B, the spring member 48 is a compression spring provided between the lower surface of the contacting member 47 and the upper surface of the holder 41.

The contacting member 47 is oriented such that an end of the contacting member 47 on the left side in FIG. 5B is positioned closer to the swing center axis (the drive shaft 39) than the other end of the contacting member 47 on the right side in FIG. 5B. The swing center axis of the contacting member 47 is on the above described one end side of the contacting member 47, and the spring member 48 is provided between the above described other end of the contacting member 47 and the holder 41. The pressing part 45 and the feed roller 11 are disposed not to overlap with each other in regard to the axis direction of the feed roller 11. The feed roller 11 and the spring member 48 are disposed to overlap with each other when viewed along the rotation axis direction of the feed roller 11.

In the pressing parts 45 and 45 configured as described above, the lower end of the spring member 48 presses a first portion 50A of the holder 41, and the contacting member 47 presses a second portion 50B of the second cover 17 at a corner part 47A formed to protrude upward. Therefore, each of the pressing parts 45 and 45 generates a pressing force with respect to the holder 41 to press the first portion 50A to move away from the second portion 50B, and thereby presses the feed roller 11 toward the first support unit 21 side.

A support shaft 51 rotatably supporting the contacting member 47 is formed integrally with the holder 41. As shown in FIGS. 7A to 7E, the support shaft 51 has a shape where parts of a circular cylinder are cut out along cutting planes parallel with the axis line of the support shaft 51 and thereby the thickness thereof in the direction orthogonal to the cutting planes is smaller than the diameter of the circular cylinder (i.e., a columnar shape in which the cross section shown in each of FIGS. 7A to 7E continues in the axis direction). The contacting member 47 is provided with a bearing 52 having the shape in which a ring-opening is formed in a part of a ring-shaped body (i.e., a shape formed in a letter "C" shown in FIGS. 7A to 7E).

As shown in FIG. 7C, the support shaft 51 and the bearing 52 are provided such that, when the rotation angle of the bearing 52 with respect to the support shaft 51 is set to a predetermined angle (within a first range), the support shaft 51 becomes able to pass through the ring-opening, and thereby the bearing 52 becomes attachable and detachable with respect to the support shaft 51. On the other hand, when the rotation angle of the bearing 52 with respect to the support shaft 51 is set to an angle (within a second range) other than the predetermined angle (see FIGS. 7D and 7E), the support shaft 51 becomes unable to pass through the ring-opening and thereby the bearing 52 moves to a state of not coming off the support shaft 51.

As shown in FIGS. 7A to 7E, the contacting member 47 is provided with a stopper 53, and the holder 54 is provided with a receiving part 54. By rotating the contacting member 47 in the direction indicated by an arrow in FIG. 7D after the support shaft 51 is attached to the bearing 52, the receiving part 54 elastically deforms and moves to a retracted position shown in FIG. 7D so as to allow the stopper 53 to swing and go over the receiving part 54. More specifically, the receiving part 54 is formed in a shape of a leaf spring extending leftward from the right end being a proximal end thereof. When the contacting member 47 is rotated in the direction indicated by the arrow in FIG. 7D, the stopper 53 presses the left end of the receiving part 54 at a first contacting surface 53A. The first contacting surface 53A is formed to have inclination by which the left end of the receiving part 54 is pushed downward when the first contacting surface 53A contacts the receiving part 54. Therefore, by pressing the receiving part 54 with the first contacting surface 53A, deformation of the receiving part 54 is induced, and thereby the stopper 53 swings easily to the position going over the receiving part 54.

On the other hand, after the contacting member 47 is moved to the above described position, the spring member 48 is disposed between the holder 41 and the contacting member 47. At this time, the spring member 48 presses the contacting member 47 in the direction indicated by an arrow in FIG. 7E, and the stopper 53 contacts the receiving part 54. However, in this case the receiving part 54 hardly deforms and thereby the receiving part 54 prevents the stopper 53 from swinging to the position going over the receiving part 54. More specifically, when the contacting member 47 is rotated in the direction indicated by the arrow in FIG. 7E, a second contacting surface 53B of the stopper 53 contacts and presses the left end of the receiving part 54 from the left side. The second contacting surface 53B has inclination to press the left end of the receiving part 54 rightward when the second contacting part 53B contacts the receiving part 54. Therefore, even when the second contacting part 53B presses the receiving part 54, the receiving part 54 hardly deforms in the up and down direction, and the stopper 53 does not move to the position going over the receiving part 54. Accordingly, the contacting member 47 does not swing to the position where the rotation angle of the bearing 52 with respect to the support shaft 51 becomes the state when in FIG. 7C, and there is no possibility that the contacting member 47 moves to the position where the contacting member 47 comes off the support shaft 51 due to the pressing force of the spring member 48.

Advantageous Effects

When a user sets a document to the first support unit 21 in the multifunction peripheral 1 configured as described above, the leading end of the document in the conveying direction is pressed against the guide part 43, and the document is fed to the space between the feed roller 11 and the first support unit 21 along the guide part 43. At this time, the holder 41 swings, and thereby the feed roller 11 moves to the position corresponding to the thickness and the number of documents. The pressing parts 45 and 45 apply the pressing force to the holder 41, and thereby the feed roller 11 is pressed toward the first support unit 21 side. Therefore, regardless of the thickness and the number of documents, it is possible to send the document to the downstream side in the conveying direction while causing the feed roller 11 to rotate and press the document appropriately. Accordingly, it is possible to send the document to the downstream side in the conveying direction without the need for complicated control in comparison with a conventional device in which a document is conveyed by utilizing the weight of a feed roller and adjustment of the rotation number of the feed roller.

Furthermore, in the above described multifunction peripheral 1, the pressing parts 45 and 45 and the feed roller 11 are disposed such that the pressing rollers 45 and 45 and the feed roller 11 do not overlap with each other in regard to the axis direction of the feed roller 11. Therefore, in comparison with a case where a structural component corresponding to the pressing part 45 is disposed to overlap with the feed roller 11 on the upper side, it is possible to decrease the size in the height direction of the structure including the feed roller 11 and the pressing parts 45 and 45 and thereby it becomes possible to decrease the thickness of the ADF unit 5.

In the above described multifunction peripheral 1, the contacting member 47 and the spring member 48 constituting the pressing parts 45 and 45 are provided on the holder 41 side having the first portion 50A, and the contacting member 47 is caused to contact the second portion 50B provided on the second cover 17 side by the pressing force of the spring member 48. Therefore, it is possible to configure the pressing parts 45 and 45 having the desired function without the need for providing components constituting the pressing parts 45 and 45 on the second cover 17 (the second portion 50B) side.

In the above described multifunction peripheral 1, the pressing parts 45 and 45 are provided on the both sides in the axis direction of the feed roller 11 while sandwiching the feed roller 11 therebetween. Therefore, it is possible to apply a well-balanced load on the feed roller 11. Since, in the above described multifunction peripheral 1, the feed roller 11 and the spring member 48 are disposed to overlap with each other when viewed along the rotation axis direction of the feed roller 11, the structure including the feed roller 11 and the spring member 48 may be made compact in size in comparison with a case where the feed roller 11 and the spring member 48 are disposed not to overlap with each other when viewed along the rotation axis direction of the feed roller 11.

In the above described multifunction peripheral 1, the contacting member 47 contacts the second portion 50B at the corner part 47. Therefore, in contrast to the case where the contacting part 47 is in surface contact with the second portion 50B, the corner part 47A can be securely caused to contact the second portion 50B even when the contacting part 47 swings, and thereby it becomes possible to prevent the contacting position on the contacting member 47 from becoming unstable.

In the above described multifunction peripheral 1, the contacting member 47 is rotatably supported by the support shaft 51 integrally formed with the holder 41. Therefore, there is no necessity to prepare a separate support shaft which is a component separately provided from the holder 41 and therefore the configuration of the pressing parts 45 and 45 may be simplified.

Furthermore, in the above described multifunction peripheral 1, the spring member 48 is provided to intervene between the contacting member 47 and the holder 41 at the position separated from the swing center of the holder 41. Therefore, in comparison with the case where the spring member 48 applies the pressing forth to a position close to the swing center of the holder 41, it is possible to cause the pressing force to effectively act on the holder 41 from the pressing parts 45 and 45.

Since the above described multifunction peripheral 1 includes the stopper 53 and the receiving part 54, when the contacting member 47 reaches the predetermined position by the pressing force from the spring member 48, the contacting member 47 becomes unable to swing further. Therefore, in contrast to the configuration where the contacting member 47 swings further from this state, it is possible to easily maintain the state where the spring member 48 is sandwiched between the contacting member 47 and the holder 41, and thereby it becomes possible to prevent the spring member 48 from falling off.

In the above described multifunction peripheral 1, when the rotation angle of the bearing 52 with respect to the support shaft 51 is set within the first range, the bearing 52 can be attached to the support shaft 51. By subsequently setting the rotation angle of the bearing 52 with respect to the support haft 51 within the second range, the bearing 52 moves to the state of not coming off the support shaft 51. In addition, since in this state the stopper 53 prevents the contacting member 47 from swinging to the position where the rotation angle of the bearing 52 is within the first range, the state where the bearing 52 does not come off the support shaft 51 may be maintained by the stopper 53. Therefore, in comparison with the case where such a configuration is not provided, the contacting member 47 may be easily attached to the holder 41, and thereby it becomes possible to prevent the attached contacting member 47 from coming off the holder 41.

In the above described multifunction peripheral 1, when the rotation angle of the bearing 52 with respect to the support shaft 51 is changed from an angle within the first range to an angle within the second range, the receiving part 54 is retracted to the retracted position by a force received from the stopper 53 and therefore the receiving part 54 does not become an obstacle. On the other hand, when trying to change the rotation angle of the bearing 52 with respect to the support shaft 51 from an angle within the second range to an angle within the first range, the receiving part 54 is not moved to the retracted position by the force received from the stopper 53. Therefore, in this case, the function as the receiving part 54 is appropriately demonstrated. Therefore, in comparison with the configuration where the receiving part 54 is not retracted or the receiving part 54 needs to be operated to retract before moving the stopper 53, the work for attaching the contacting part 47 may be eased.

Other Embodiments

The concrete embodiment of the sheet conveyer and the image reading apparatus have been explained by giving the example of the multifunction peripheral 1; however, the invention is not limited to the above described embodiment, but can be varied within the scope of the invention.

For example, in the above described embodiment, the example where the pressing part 45 is formed of the contacting member 47 and the pressing member 48 is given; however, the pressing part may be formed only of the spring member 48 by omitting the contacting member 47. Alternatively, in the case where the contacting member 47 is provided, whether to provide the contacting member 47 to be swingable is optional, and therefore the contacting part 47 may be provided to be slidable in the up and down direction.

In the above described embodiment, the pressing part 45 is provided on the holder 41 side, and is configured to contact the second cover 17; however, a component corresponding to the pressing part 45 may be provided on a component corresponding to the second cover 17 and may contact a component corresponding to the holder 41.

In the above described embodiment, the pressing part 45 contacts the second cover 17; however, when a member having the function different from that of the second cover 17 is provided on the upper side of the pressing part 45, the pressing part 45 may contact the member. That is, whether or not a target component which the pressing part 45 contacts is a member having the function as a cover is optional.

In the above described embodiment, the reading unit 3 corresponding to the image reading apparatus and the ADF unit 5 corresponding to the sheet conveyer 5 are provided in the multifunction peripheral 1; however, the configuration of the embodiment may be used in a single-function image scanner.

What is claimed is:

1. A sheet conveyer, comprising:

a sheet support surface configured to support sheets;

a first roller configured to convey the sheets supported by the sheet support surface to a downstream side in a conveying direction;

a second roller configured to separate one by one the sheets conveyed by the first roller to convey a sheet to the downstream side in the conveying direction;

a holder configured to be swingably supported about a swing center axis coinciding with a rotation center of the second roller, wherein the first roller is attached to the holder to be rotatable about an axis parallel with the swing center axis; and a pressing unit configured to press the first roller toward the sheet support surface by applying a pressing force to the holder, wherein the pressing unit is disposed between a first portion of the holder and a second portion opposite to the sheet support surface with respect to the holder, the pressing unit is configured to press the first portion to move away from the second portion, and the pressing unit and the first roller are disposed to overlap with each other at least partially when viewed along a width direction of the sheet support surface, the width direction being perpendicular to the conveying direction.

2. The sheet conveyer according to claim 1, wherein the pressing unit comprises:

a contacting member attached to the holder to be movable with respect to the holder, the contacting member being movable in a direction approaching the second portion; and a spring member disposed between the holder and the contacting member to displace the contacting member in the direction approaching the second portion.

3. The sheet conveyer according to claim 2, wherein the pressing unit is provided on both sides in an axial direction of the first roller to sandwich the first roller from both sides in the axial direction.

4. The sheet conveyer according to claim 2, wherein the first roller and the contacting member are disposed to overlap with each other when viewed along an axial direction of the first roller.

5. The sheet conveyer according to claim 2, wherein:

the contacting member comprises a corner part formed to protrude upward; and the contacting member contacts the second portion at the corner part.

6. The sheet conveyer according to claim 2, wherein:

the holder is integrally provided with a support shaft which swingably supports the contacting member; and the spring member is provided between the contacting member and the holder.

7. The sheet conveyer according to claim 6, wherein:

the contacting member is oriented such that one end of the contacting member is disposed to be closer to the swing center axis of the holder than an other end of the contacting member and a swing center of the contacting member is disposed to be closer to the one end of the contacting member; and the spring member is disposed between the holder and the other end of the contacting member.

8. The sheet conveyer according to claim 6, wherein:

the contacting member comprises a stopper and the holder comprises a receiving part; and when the contacting member swings to a predetermined position by the pressing force of the spring member, the stopper contacts the receiving part and swinging of the contacting member going over the predetermined position is prevented.

9. The sheet conveyer according to claim 8, wherein:

the support shaft has a shape where a part of a circular cylinder is cut out along a cutting plane parallel with an axis of the support shaft and thereby a thickness in a direction orthogonal to the cutting plane is smaller than a diameter of the circular cylinder;

the contacting member is provided with a bearing having a shape in which a ring-opening is formed in a part of a ring-shaped body;

when a rotation angle of the bearing with respect to the support shaft is set within a first range, the support shaft becomes able to pass through the ring-opening and thereby the bearing becomes attachable and detachable with respect to the support shaft;

when the rotation angle of the bearing with respect to the support shaft is set within a second range, the support shaft becomes unable to pass through the ring-opening and thereby the bearing moves to a state where the bearing does not come off the support shaft; and by contacting the receiving part, the stopper prevents the contacting member from swinging to a position at which the rotation angle of the bearing with respect to the support shaft is within the first range.

10. The sheet conveyer according to claim 9, wherein:

the stopper is configured to be elastically deformable to be retracted to a retracted position where movement of the stopper is allowed;

the stopper comprises a first contacting surface which contacts the receiving part when the rotation angle of the bearing with respect to the support shaft is changed from the first range to the second range, and a second contacting surface which contacts the receiving part when the rotation angle of the bearing with respect to the support shaft is changed from the second range to the first range;

the first contacting surface is formed to have an inclination by which a component force of a force acting on the receiving part from the first contacting surface in relation to a moving direction of the stopper causes the receiving part to displace to the retracted position; and the second contacting surface is formed to have an inclination by which a component force of a force acting on the receiving part from the second contacting surface in relation to a moving direction of the stopper causes the receiving part not to displace to the retracted position.

11. The sheet conveyer according to claim 1, wherein the holder is configured to be able to change an interval between the first roller and the sheet support surface by swinging together with the first roller.

12. The sheet conveyer according to claim 1, wherein the pressing unit and the first roller are disposed not to overlap with each other when viewed along a direction perpendicular to the sheet support surface.

13. An image reading apparatus, comprising:

a reading unit configured to read an image on a sheet conveyed along a predetermined conveying direction;

a sheet support surface configured to support sheets;

a first roller configured to convey the sheets supported by the sheet support surface to a downstream side in a conveying direction;

a second roller configured to separate one by one the sheets conveyed by the first roller to convey a sheet to the downstream side in the conveying direction;

a holder configured to be swingably supported about a swing center axis coinciding with a rotation center of the second roller, wherein the first roller is attached to the holder to be rotatable about an axis parallel with the swing center axis; and a pressing unit configured to press the first roller toward the sheet support surface by applying a pressing force to the holder, wherein the pressing unit is disposed between a first portion of the holder and a second portion opposite to the sheet support surface with respect to the holder, the pressing unit is configured to press the first portion to move away from the second portion, and the pressing unit and the first roller are disposed to overlap with each other at least partially when viewed along a width direction of the sheet support surface, the width direction being perpendicular to the conveying direction.

14. The image reading apparatus according to claim 13, wherein the holder is configured to be able to change an interval between the first roller and the sheet support surface by swinging together with the first roller.

15. The image reading apparatus according to claim 13, wherein the pressing unit and the first roller are disposed not to overlap with each other when viewed along a direction perpendicular to the sheet support surface.

* * * * *